US007566196B2

(12) United States Patent
French

(10) Patent No.: US 7,566,196 B2
(45) Date of Patent: Jul. 28, 2009

(54) CABLE TRANSPORT SYSTEM AND METHOD FOR LOADING AND UNLOADING SPOOLS

(75) Inventor: Craig French, Suring, WI (US)

(73) Assignee: Great Lakes Manufacturing Inc., Suring, WI (US)

( * ) Notice: Subject to any disclaimer, the term of this patent is extended or adjusted under 35 U.S.C. 154(b) by 764 days.

(21) Appl. No.: 10/782,882

(22) Filed: Feb. 23, 2004

(65) Prior Publication Data

US 2004/0251374 A1 Dec. 16, 2004

Related U.S. Application Data

(60) Provisional application No. 60/448,473, filed on Feb. 21, 2003, provisional application No. 60/457,767, filed on Mar. 24, 2003.

(51) Int. Cl.
*B60P 1/48* (2006.01)
*B60P 3/035* (2006.01)

(52) U.S. Cl. ..... 414/482; 414/458; 414/911

(58) Field of Classification Search ..... 414/228, 414/431, 24.5, 482, 911, 458; 280/769; 248/451, 248/441.1; 211/64, 63, 68, 67, 75
See application file for complete search history.

(56) References Cited

U.S. PATENT DOCUMENTS

| | | | | |
|---|---|---|---|---|
| 1,052,096 | A | 2/1913 | Schulze | |
| 1,587,842 | A * | 6/1926 | Knox | 414/457 |
| 1,678,395 | A | 7/1928 | Kellems | |
| 2,679,987 | A | 6/1954 | Saliba | |
| 2,693,285 | A | 11/1954 | Buschbom | |
| 2,775,357 | A * | 12/1956 | De Arment | 414/458 |
| 2,793,773 | A * | 5/1957 | De Boliac | 414/458 |
| 2,867,390 | A | 1/1959 | Anrig | |
| D181,438 | S | 11/1959 | Petersen | |
| D186,589 | S | 11/1959 | Petersen et al.. | |
| 2,941,678 | A | 6/1960 | Keys | |
| 3,013,676 | A | 12/1961 | Daniels, Jr. | |
| 3,091,413 | A | 5/1963 | Leithiser | |
| 3,184,082 | A | 5/1965 | Hall | |
| 3,321,147 | A | 5/1967 | Martin | |
| 3,325,118 | A | 6/1967 | Hall | |
| 3,677,428 | A | 7/1972 | Mallett | |
| 3,690,491 | A | 9/1972 | Butler, Jr. | |
| 3,820,673 | A | 6/1974 | McVaugh | |
| 3,860,193 | A * | 1/1975 | Green | 242/557 |

(Continued)

*Primary Examiner*—James Keenan
(74) *Attorney, Agent, or Firm*—Birch, Stewart, Kolasch & Birch, LLP

(57) ABSTRACT

A trailer and a system for picking up and centering spools and a method for stabilizing the trailer when not attached to a towing vehicle. The device to pick up and hold the spools of cable utilizes the mechanical advantages that are gained through the use of a fulcrum and a lever. The use of the fulcrum increases mechanical advantage making it possible to lift and transport heavy spools by a single individual without the use of hydraulics, electric motors, pulley systems and numerous other embodiments. Another feature of this invention is the position and pivoting action of the rack and range of motion of the rack. The angled support rail pivots along with the rack. The pivoting rack has a pocket system with a built-in locking device that secures the spool during transport. The pockets facilitate easy pick-up and form a secure nesting position for the spool.

30 Claims, 15 Drawing Sheets

U.S. PATENT DOCUMENTS 3,931,893 A * 1/1976 Elkins et al. ..... 211/64
3,931,902 A 1/1976 Love, Jr.
3,935,954 A * 2/1976 Woods et al. ..... 414/24.5
3,941,324 A 3/1976 Green
3,946,887 A 3/1976 Parker
4,044,963 A 8/1977 Hostetler
4,095,706 A * 6/1978 Schwien et al. ..... 414/24.6
4,108,313 A * 8/1978 Bogar, Jr. ..... 211/64
4,174,809 A 11/1979 Arlemark
4,213,729 A * 7/1980 Cowles et al. ..... 414/462
4,413,761 A * 11/1983 Angel ..... 224/485
4,437,622 A 3/1984 Heider
4,583,700 A 4/1986 Tschurbanoff
4,585,264 A 4/1986 Miller
4,588,142 A 5/1986 Malzacher
4,635,983 A 1/1987 Boland et al.
4,643,397 A 2/1987 Munns
4,701,098 A * 10/1987 Bills et al. ..... 414/502
4,703,969 A 11/1987 Rayburn et al.
4,726,566 A 2/1988 Boland et al.
4,762,291 A 8/1988 Sauber
4,767,073 A 8/1988 Malzacher
5,123,602 A 6/1992 Skalleberg et al.
5,139,751 A 8/1992 Mansfield et al.
5,203,658 A * 4/1993 Henderson ..... 414/24.6
5,332,166 A 7/1994 Kepes
5,584,639 A * 12/1996 Walker, Jr. ..... 414/476
5,632,470 A 5/1997 Leland
5,746,410 A * 5/1998 Hung ..... 248/441.1
5,897,073 A 4/1999 McVaugh
6,217,053 B1 * 4/2001 Forsythe et al. ..... 280/414.3
6,305,894 B1 * 10/2001 Dearborn ..... 414/24.5
6,347,761 B1 2/2002 Larson
6,648,578 B1 * 11/2003 Rouse ..... 414/482
7,055,425 B2 * 6/2006 Viaud et al. ..... 100/88
7,114,376 B2 * 10/2006 Loucks et al. ..... 73/73
7,137,642 B2 * 11/2006 Mitchell ..... 280/418.1
2002/0003186 A1 1/2002 Hinds

* cited by examiner

CABLE TRANSPORT SYSTEM AND METHOD FOR LOADING AND UNLOADING SPOOLS

This application claims priority under 35 U.S.C. §119(e) of provisional application No. 60/448,473, filed Feb. 21, 2003, and provisional application No. 60/457,767, filed Mar. 24, 2003, the entire contents of each of which are hereby incorporated by reference.

BACKGROUND OF THE INVENTION

1. Field of the Invention

The present invention relates to an improved cable transporting method and system for the loading, unloading, transporting, and delivery of spools, cable, or wire. More particularly, the present invention is directed to a self-contained trailer which can accommodate variable weights and sizes of spools that are needed to be conveniently transported to the job site.

2. Description of the Background Art

The prior art illustrates a variety of spool handling devices for both transporting and installing various types of cable. There are numerous patents relating to the winding and unwinding of cable from a reel or spool.

U.S. Pat. No. 1,052,096 (Schulze) and U.S. Published Application No. 2002/0003186 (Hinds) represent the general prior art which has utilized predominantly trailers, trucks or other vehicles that have been utilized for mounting the spools. Devices from air motors to hydraulic motors, electric, or other power equipment or sources have been described in the art.

U.S. Pat. No. 4,703,969 (Rayburn) and U.S. Pat. No. 4,585,264 (Miller) show racks for trucks or pickup truck beds. The drawback is that these are permanently mounted units. The high costs of the initial investments in the vehicles is a drawback because the vehicles are only usable for one purpose. This is because of the permanently installed winches and large racks.

U.S. Pat. No. 3,931,902 (Love, Jr.) shows a carrier that transporting heavy reels and the like which includes a pair of laterally spaced, rearwardly extending, wheeled frame beams defining a rearwardly open space for receiving the reel. Uprights are secured to the beams and pivotally support hydraulically actuated, rearwardly directed elongated arms for pivotal movement in vertical planes. Reel axle support bars have upper ends hinged to the arm rearwards and are movable with the arms from a lower lifting position to an upper transporting position. The Love patent shows the use of a rack constructed from channel steel support bars comprising upwardly open notches and laterally directed openings. Openings are cut out of the channel steel leaving a U-shaped notch. The rack relies on gravity and the weight of the spool to hold the spool in place during transport.

In the Love patent, the loading of the spool would need extra mechanical help in order for the spool to be placed into the notch and opening. By maneuvering the spool, the operator can place the left side of the spindle into the left side notch. The right side of the spindle would then have to be retracted toward the spool in order for the right spindle to enter the opposing notch and opening. The spool would have to be supported during the maneuver by an operator or if the spool was larger, a movable mechanical jack. In the Love patent, the hydraulic cylinders must have equal pressure applied to them or the load becomes tilted. Problems with the hydraulic cylinders, such as worn out seals, occur as they tend to age, leaving the arms tilted. The spool could then slide from side to side.

U.S. Pat. Nos. 3,184,082 and 3,325,118 (Hall), U.S. Pat. No. 5,123,602 (Skalleberg et al.) and U.S. Pat. No. 6,347,761-B1 (Larson) show reel handlers that are utilized for loading and unloading with the use of friction rollers contacting the periphery of the reels.

The use of cable spools or other devices are known in the art for dispensing or installing cable in the ground. For example, U.S. Pat. Nos. 4,437,622 (Heider), 4,635,983 (Boland, et al.), 4,643,397 (Munns), 4,726,566 (Boland) and 5,632,470 (Leland) show various devices that are complex assemblies for dispensing or installing cable with powered hydraulic drives or other powered spooling systems.

U.S. Pat. No. 5,332,166 (Kepes) shows a device for stringing and unstringing reels or spools for cable, wire or other numerous embodiments that are non-mobile.

Heretofore, there has been prior art relating to mechanisms that handle, lift, load, stack and transport hay bales by clamping and lifting stacks of bales. These devices are connected to trailers, tractors, other traction devices, farm vehicles, trucks and other equipment or vehicles. Most of the devices are utilizing hydraulic power for lifting. The engaging and holding arms clasp the bales attached at the bale-lifting arms ends with metal plates attached to their inner side ends. Forward projecting tines and bale engaging members assist in securing the bale from the inward end of the frame assembly.

U.S. Pat. No. 2,867,390 (Anrig) shows the use of a conventional hand winch mounted on the platform at one side and a power driven winch mounted on the platform, one end of a flexible member or rope secured to the hand winch drum and a portion wound thereon with the rope extending rearwardly and over a pulley or rotatably mounted adjacent the rear ends of the rail. Anrig's patent describes the use of a rope and pulley system, powered by either a hand or a power winch, but they are used in an unconventional way where they are both utilized at the same time, one moving and the other acting as an anchor. They are using pulleys to gain mechanical advantage when lifting a spool onto the trailer.

Still other machines are designed to just install the cable or wind the cable back on the spool.

SUMMARY OF THE INVENTION

The present invention is directed to a system and method for utilizing the mechanical advantages that are gained with the use of the lever and fulcrum. In the preferred embodiment, the use of the fulcrum and lever increases the mechanical advantage making it possible to lift and transport heavy spools without the use of hydraulics, electric motors, pulley systems and numerous other embodiments. Another feature of this invention is the position and pivoting action of the rack and range of motion of the rack. The angled support rail pivots along with the rack.

The new and improved pivoting rack and pocket system includes a built-in locking system that secures the spool during transport. The pockets are designed to facilitate easy pickup, and form a secure nesting position for the spool spindles. The locking system is easy to secure and release with the spool engaged. The greater the amount of cable unwound, the closer the pivoting rack moves toward a horizontal position. The cable is then manually wound downwardly onto the mechanical winch, raising the pivoting spool rack upwardly into the transporting position. This entire procedure can be accomplished by one individual.

The apparatus is capable of being modified to pick up and transport bales. The bale handling operation includes placing a penetrating bar through the bale and then securing the spindle in the spindle support rack. The spindle securing and locking rack is fabricated inside the rack. Another method of securing the bales requires the use of a plate upon which prong type rods are mounted, the rods being held in the bale by locking collars.

Advantages of the present invention include the following:

1. Can be operated by one person.

2. Can handle a variety of sizes and weights of spools.

3. Can deliver spools to job sights without damaging spools, property or individuals due to the use of the pockets and locking system. The pockets are fabricated out of heavy plate steel, and are reinforced with a middle layer of support. The pockets are designed and fabricated for strength and safety.

4. Can handle multiple spools at a one time.

5. Can be customized to accommodate any size spool.

6. Can be used where gasoline engines and electric motors cannot be used due to restrictions on fueling or where electricity is not available.

7. Hydraulic pumps motors, lines, fluid and filters are unnecessary. This complexity has disadvantages, one such disadvantage is that it is more costly to manufacture and for most employees more complex to utilize and to keep the machine in running condition.

8. Reduces employee and fuel costs for the operation of the system.

9. Lower cost in manufacturing the unit, no hydraulics or engine or power supplies are needed and this further relates to lower emissions.

10. The weight range for the cable transporting system is approximately between two thousand and ten thousand pounds.

The present invention is directed to a trailer comprising square tubular steel which serves as a supporting platform for a cable spool transporting system. The trailer has jack stands at either end to stabilize the trailer when not connected to a towing vehicle. The trailer may have a single axle and two tires, or the trailer may have two axles and four tires to accommodate heavier loads. The trailer has a tongue with a conventional hitch mounted at the front of the tongue. The tongue is designed to accommodate various size hitches determined by the size of the ball or clevis on the towing vehicle. The rear of the trailer is open to afford the loading, transporting, and unloading of spools. The trailer may be designed and fabricated in a variety of tubular steel weights to accommodate a variety of spool weights and sizes. The trailer is fabricated using angle iron, box-beam steel, or extruded aluminum or other metals or wood.

The present invention is directed to a loading system for spools, which includes square tubular and plate steel, or other material that has the correct tensile strength. The loading system is supported by a U-shaped yoke welded or bolted or otherwise fastened to a vertical support member on the front end of a lever and by two vertical members which are upwardly diagonal, with a trapezoidal steel plate used to join them on the rear end and on either side of the trailer. The vertical members form a triangle wherein the two bottom corners are fastened to the trailer and the steel plate is at the apex of the triangle. The trapezoidal plates have holes drilled, cast, cut or stamped in them to accommodate a pin and to function as a fulcrum.

A horizontal lever arm is supported by the yoke at the front and connecting centered and perpendicularly to a horizontal lateral cross member. The lateral cross member runs from side to side on the trailer, and is connected to two other horizontal members which run rearwardly through the trapezoidal steel plate or plates with a hole and a pin and are pinned in position to produce a lever arm attached to a fulcrum.

A rack is composed of an outer steel plate, interior strengthening members and an inner steel plate, or other material that has the correct tensile strength. The back of the rack is attached to a fabricated square steel tube. Both the rack and the tube are then attached vertically on the horizontal members running through the fulcrum. U-shaped pockets on the rack form a resting and securing place for the ends of the spindles upon which the spools of cable are positioned. A locking device and a securing rack serve to hold the spindles in the rack pockets. They are fabricated or constructed inside the steel tubing or other material with a handle running exterior from the tube to engage and disengage the securing rack. The securing rack is kept in position by the locking device which is spring loaded to hold it in the desired position either locking, engaged, unlocked, or disengaged.

The loading system is constructed from a plurality of steel tubing having variances in wall thickness and dimensions. The trapezoidal steel plates are positioned either rearward or forward from their present position, thus altering the mechanical advantage of the lever arm. The pockets are of a plurality of sizes and dimensions to accommodate various spool and spindle diameters. The lever arms or the front support rail are lengthened or shortened thus altering the mechanical advantage of the lever arm.

The loading system may be configured without the securing rack and locking device, wherein gravity holds the spool spindles in place.

The rack with pockets is fabricated or cast out of a variety of steel or other materials and configurations but not limited to box-beams, round tubular steel, channel iron or other substitutable materials that comply with the need for sufficient strength and road worthiness. The spool is secured in position on the spindle using locking and centering collars, lynch pins or other suitable devices on both sides of the spool.

The loading system may be adapted to carry bales, the bales being held in place by bale penetrating bars which are supports by the pockets in the rack. The bale penetrating bars may be replaced by bale engaging and holding members, which are rotatably mounted on the spindle bars and are held in place by the spindle collars. They are permitted to rotate over the bars or spindles allowing the bale to unroll. The same being true for other roll form materials. A modified holding system may be used that is mount ed or secured in place by a mounting plate having a plurality of penetrating prongs which engage the bale. The plate is rotatably positioned on the spindles and held in place by the collars. The prongs are directed laterally into the bale.

The present invention has a rack that is fabricated out of steel plate that is stronger. The new rack is fabricated out of an outer plate, interior strengthening material and an interior plate. This affords the support for heavier spools that is lacking in the prior art. The newly designed pockets of the present invention eliminates the problem of the racks tilting in the prior art. Further, the improvements in the locking rack and pocket are safer for transporting the spools.

Methods of transporting spools are highly in demand as utility companies replace wire with fiber optic cable, as well as due to the installation of television cable, telephone cable, and data transmission cable. With this new and improved embodiment, a single person can both load and unload spools regardless of the spools size or weight and with or without access to a power supply.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
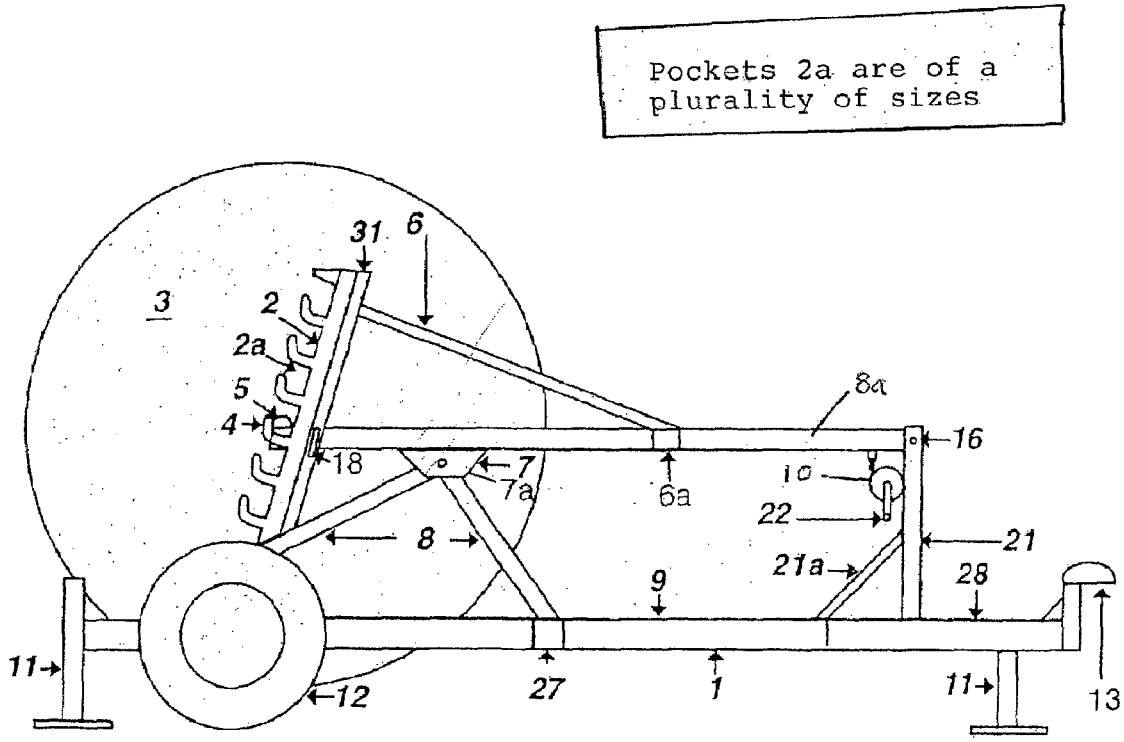
FIG. 1 is a side view of the cable transporting trailer showing a spool loaded thereon.
Figure 2A:
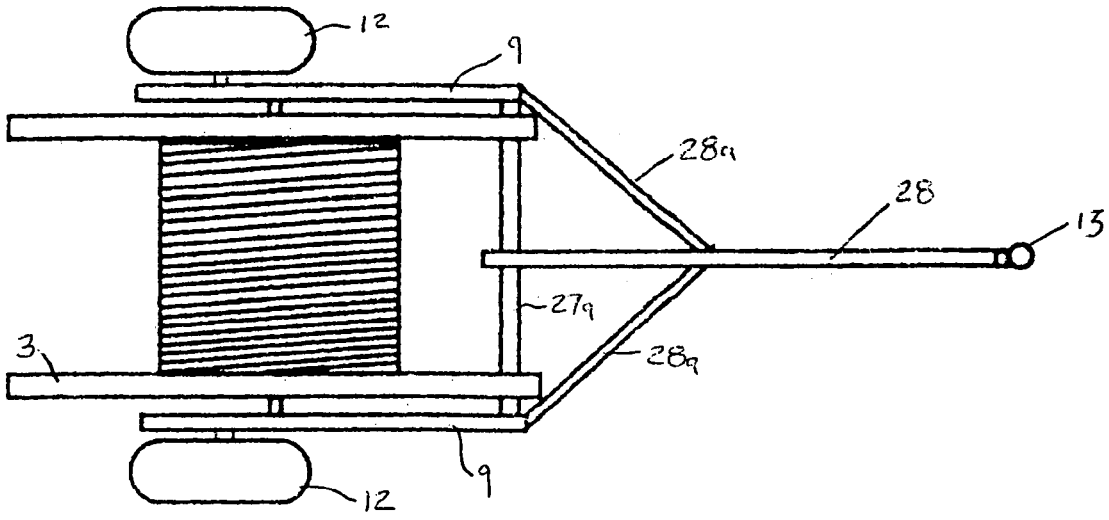
FIG. 2A is a schematic view of the trailer showing a top view with the spool centered on the trailer.
Figure 2B:
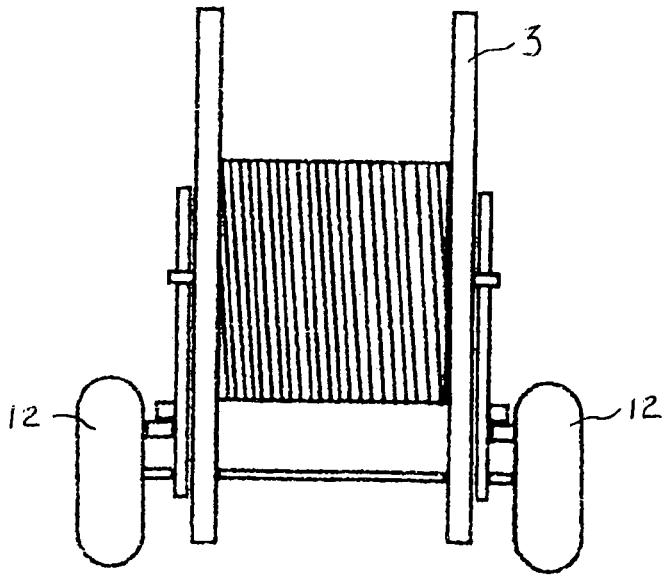
FIG. 2B is a schematic view of the trailer showing an end view with the spool centered on the trailer.

Referring in detail to the drawings, and with particular reference to FIG. 1, a cable transporting trailer 1 of the present invention is shown that supports the comprehensive cable transport system and method for loading and unloading spools.

Figure 3B:
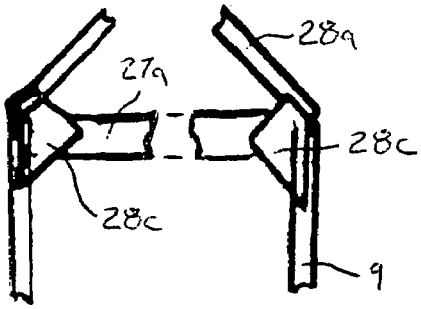
FIG. 3B is a top view showing a variation of the configuration for the trailer's supporting members and the tires.
Figure 3A:
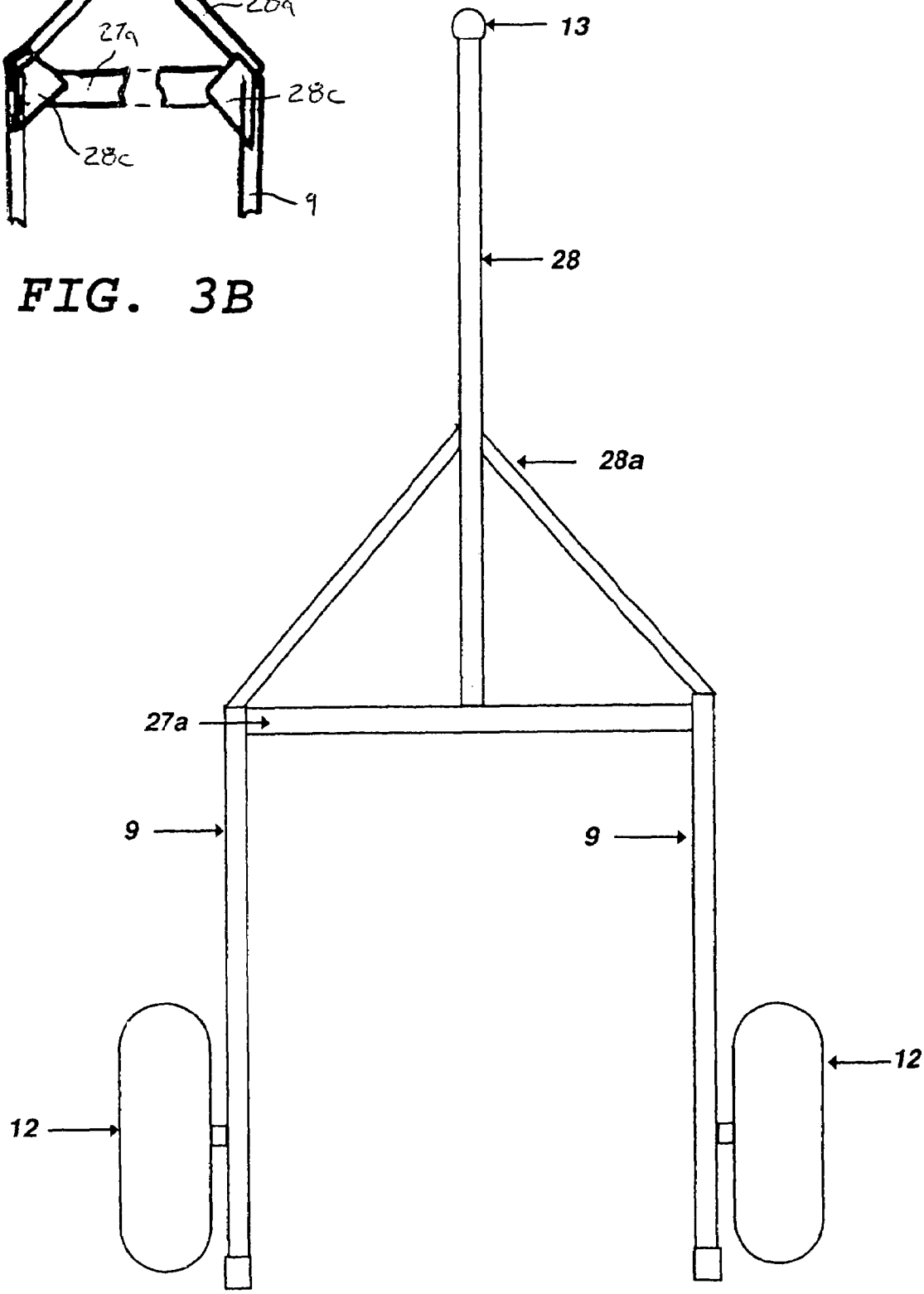
FIG. 3A is a top view showing the basic configuration for the trailer's supporting members and the tires.
Figure 4:
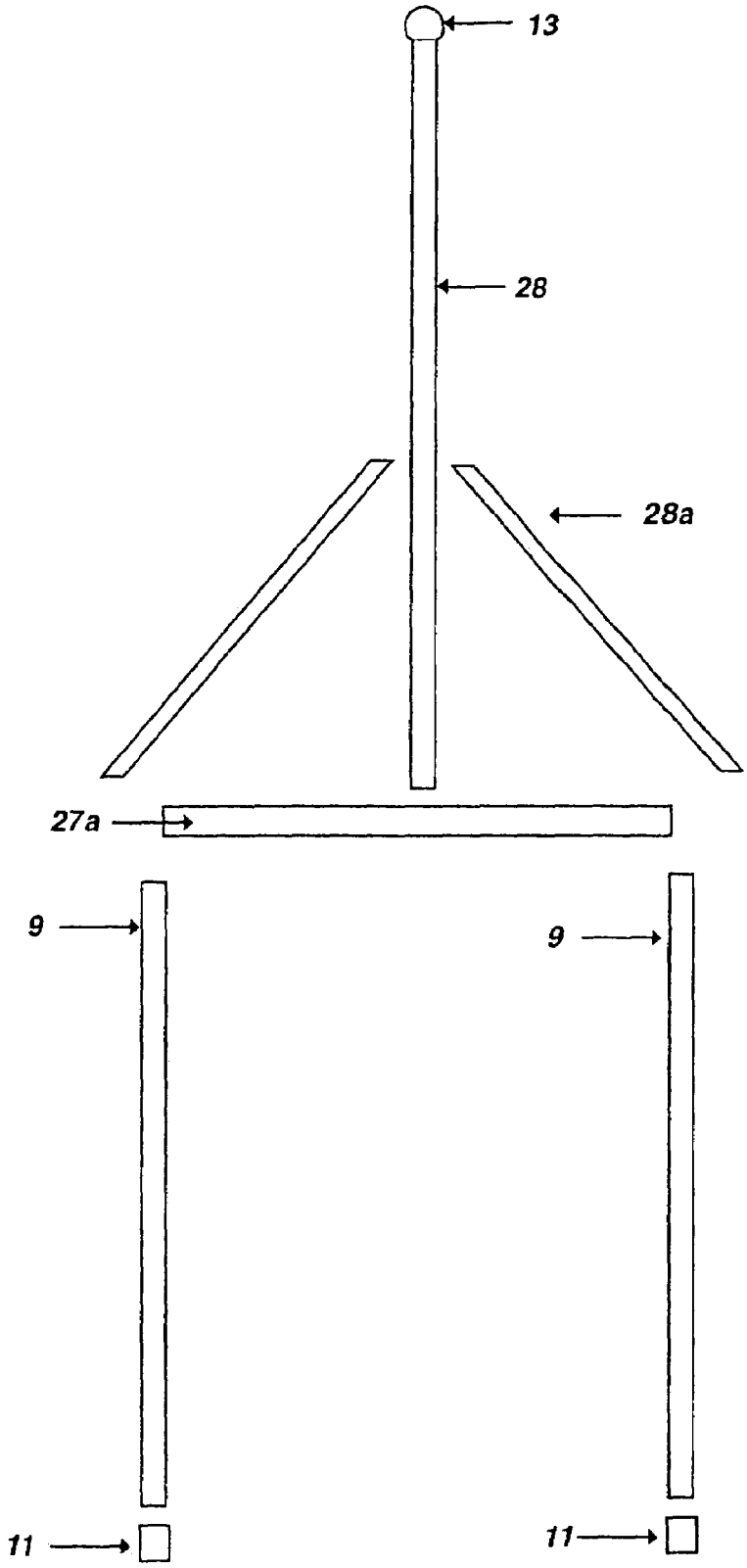
FIG. 4 is an exploded view showing the actual members of the trailer prior to welding of said members.
Figure 5:
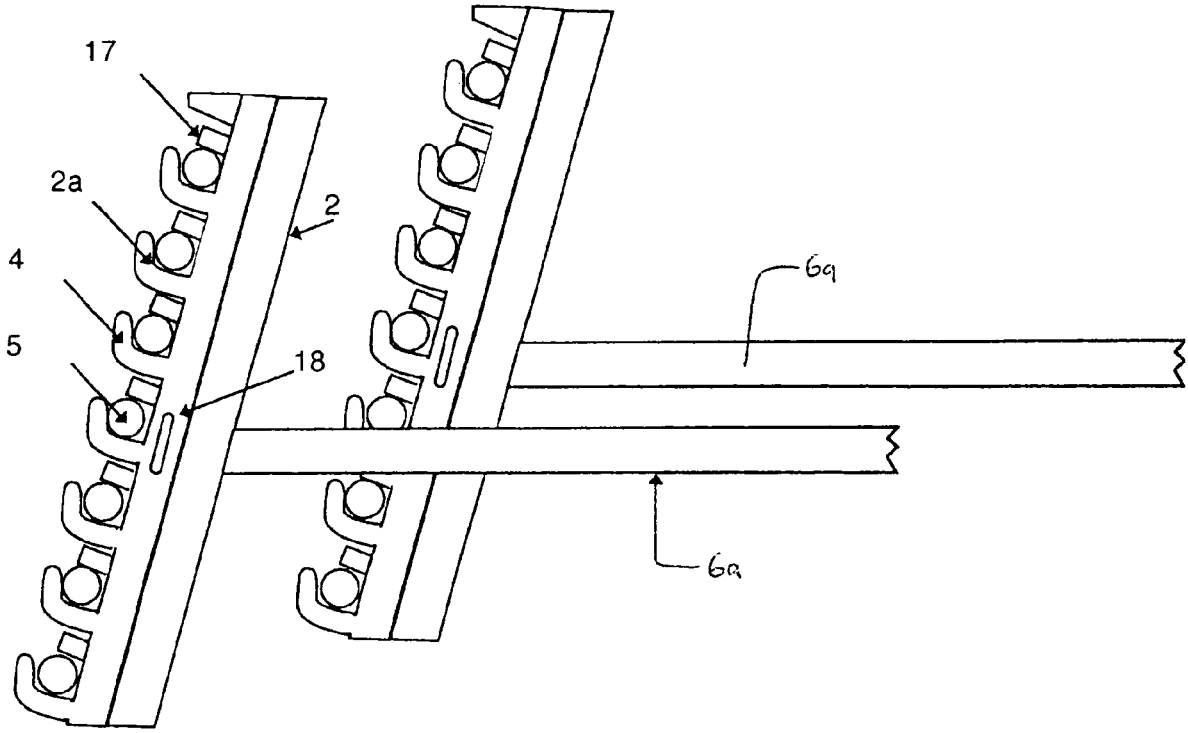
FIG. 5 is a perspective view showing the pivoting spool rack with a spindle in each of the pockets.
Figure 6A:
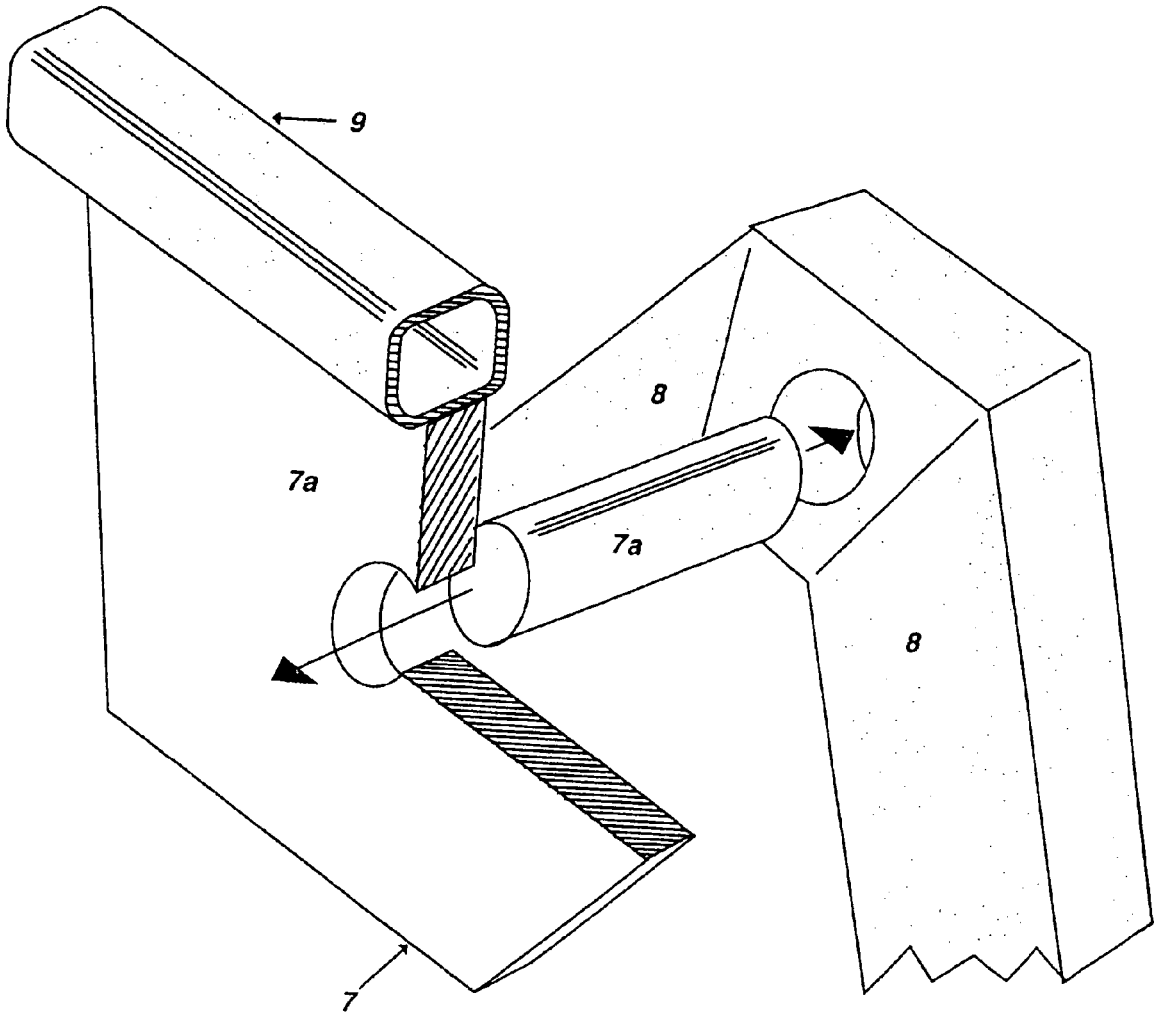
FIG. 6A is a perspective view showing the vertical and horizontal support members with the fulcrum assembly attached to the horizontal member.
Figure 6B:
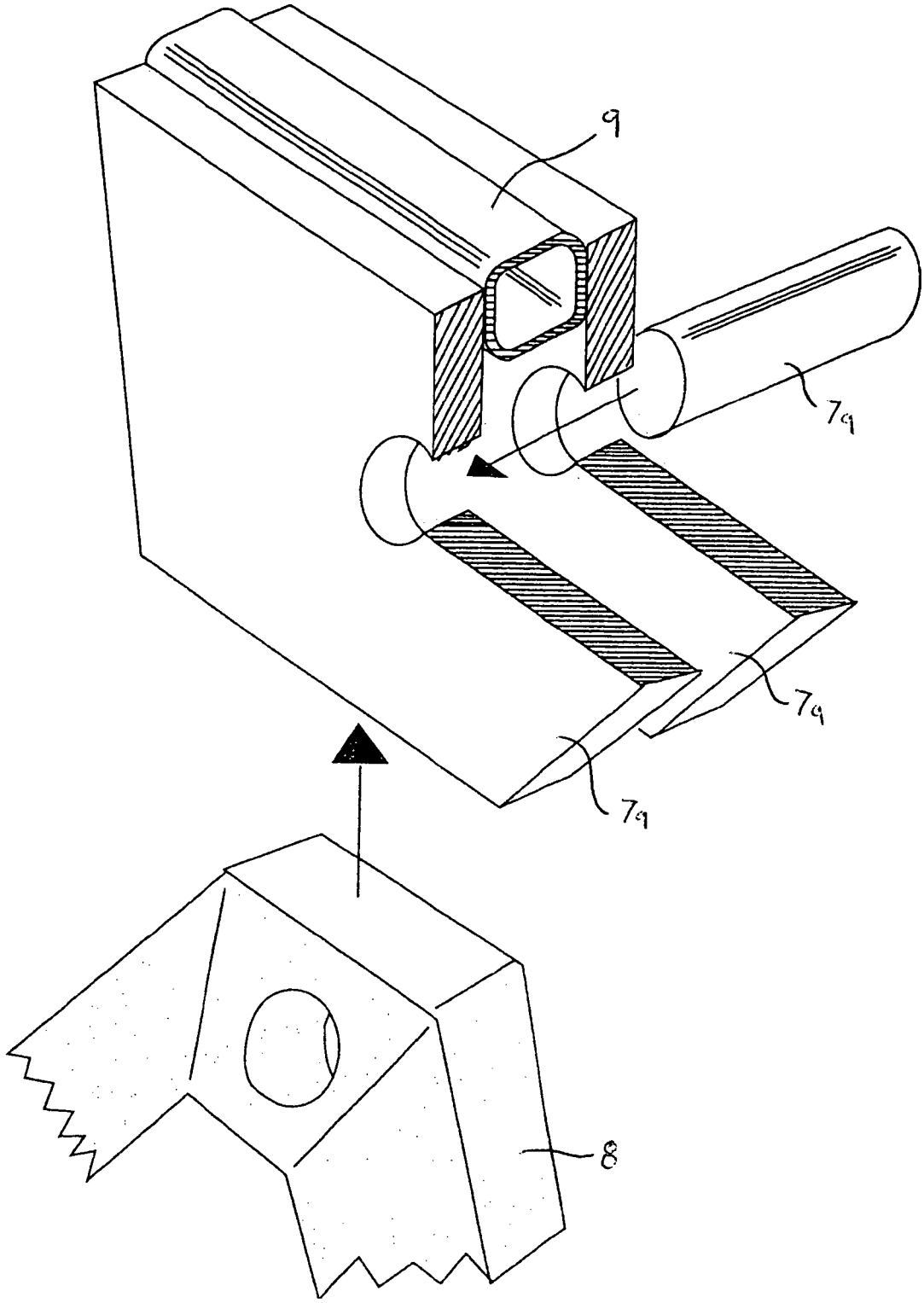
FIG. 6B is a perspective view showing the vertical and horizontal support members of an alternative method of construction for the fulcrum assembly and the supporting members.
Figure 7A:
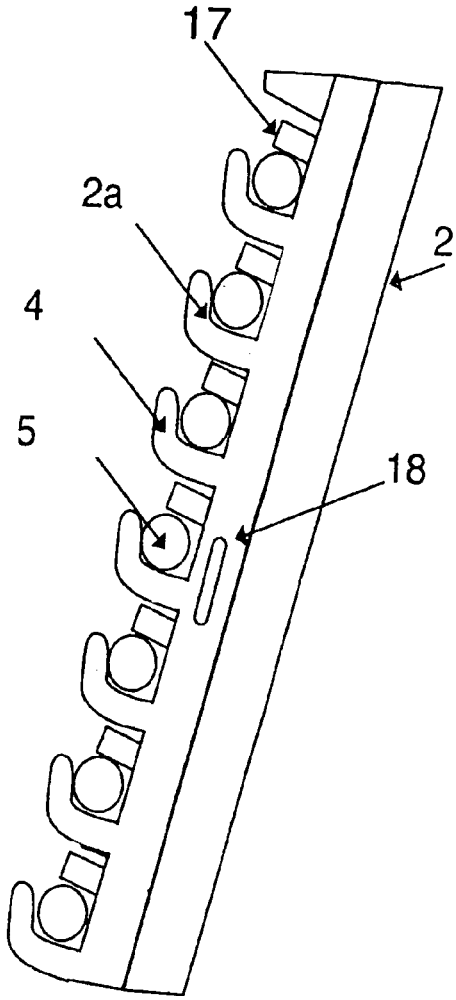
FIG. 7A is a side view showing the pivoting spool rack with the locking bar in place and securing the spindles of proposed spools.
Figure 7B:
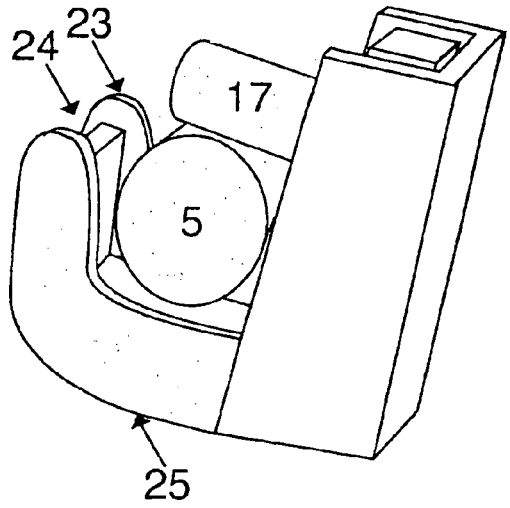
FIG. 7B is an enlarged view of the interior plate with pockets, support layer, and support steel.
Figure 8:
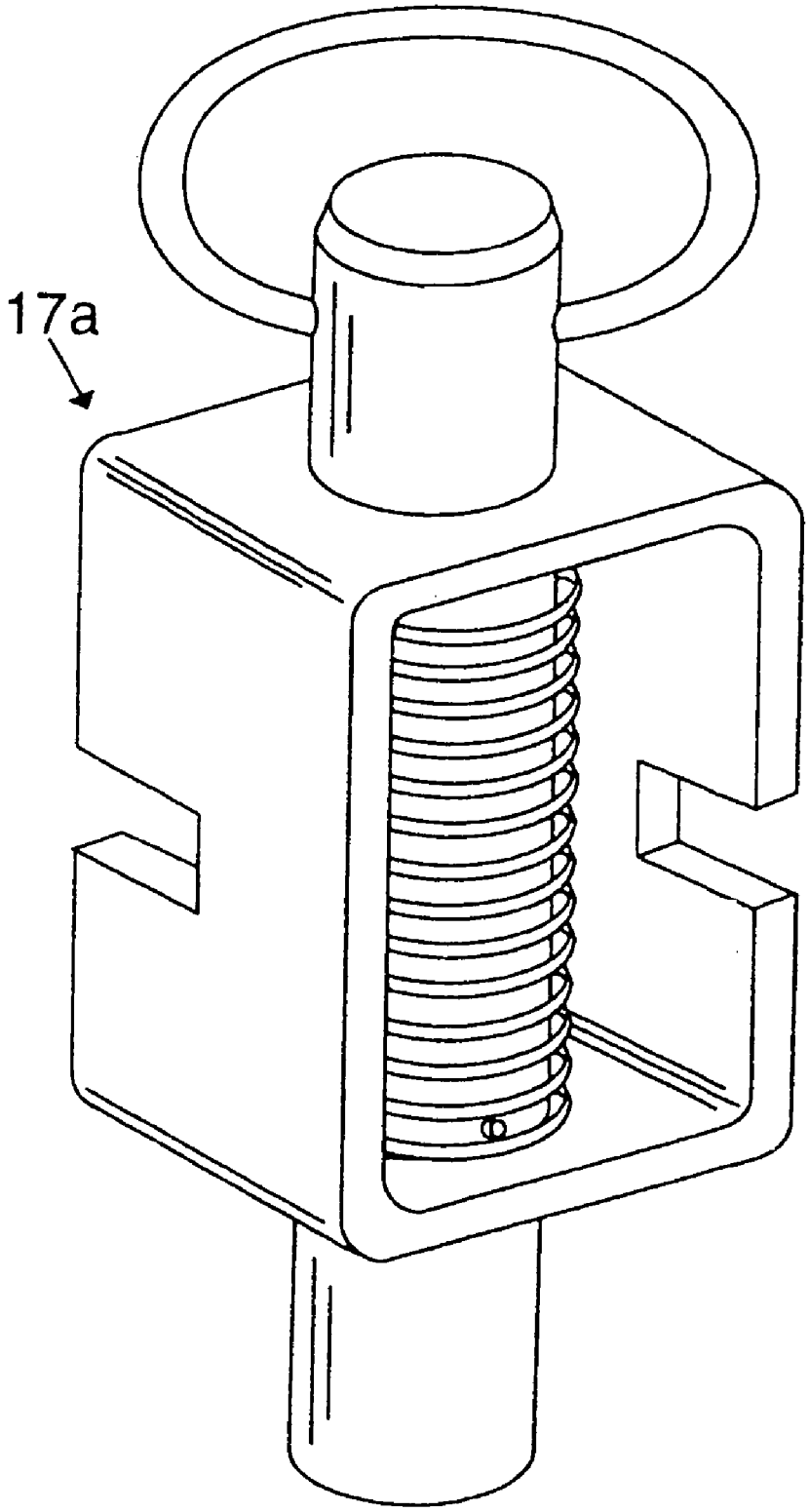
FIG. 8 is a view showing the locking mechanism that is used to secure the locking bar.

FIGS. 3A, 3B and 4 show the basic configuration of the bed of the cable transporting trailer 1 before any welding of the frame members is undertaken. The trailer 1 is comprised of a fabricated steel trailer frame. A set of parallel wheel assemblies 12 are located on the basic frame for the system. A pair of horizontal rails (support arms) 9 are connected at forward ends by a lower lateral cross member 27A, and to the lower diagonal support rails 28A that attach to the tongue 28. In FIG. 3B, gussets 28C are used to reinforce the connection between the horizontal rails 9, the lower lateral cross member 27A, and the lower diagonal support rails 28A.

A trailer hitch 13 is connected to the front end of the tongue 28 for towing. The tongue 28 extends rearwardly to the lower lateral support member 27A. Attached to the rearward and forward end of the horizontal rails 9 are a pair of jack stands 11 that are located to help stabilize and support the trailer or carrier when it is not connected to a towing vehicle. The jack stands 11 have a hinge that is pivotally mounted so that the stands pivot backwards toward the horizontal rails 9 where they can be secured when the trailer is connected to a towing vehicle. A locking pin is placed thru an opening in the hinge which prevents the dislodging of the jack stands 11 due to vibration and stress during transport.

A bottom of a vertical support member 21 is attached on the top of the tongue 28 and on the forward three-fourths area of the tongue 28, and is reinforced by an angled gusset 21*a*. Attached to the vertical support 21 member at the top end is a U-shaped yoke 16. The rails are angularly hinged to support rails (fulcrum arms) 8. The yoke 16 supports the lever arm 8*a* which is used to raise and lower the spools. There is a pin 30 which locks the lever arm 8*a* in position located just above the U-shaped yoke 16, and secures the lever arm 8*a* in a down position during transport. To raise the lever arm 8*a* and pick up a spool 3, the pin 30 must be removed. This engages the method for loading a spool 3.

Figure 9:
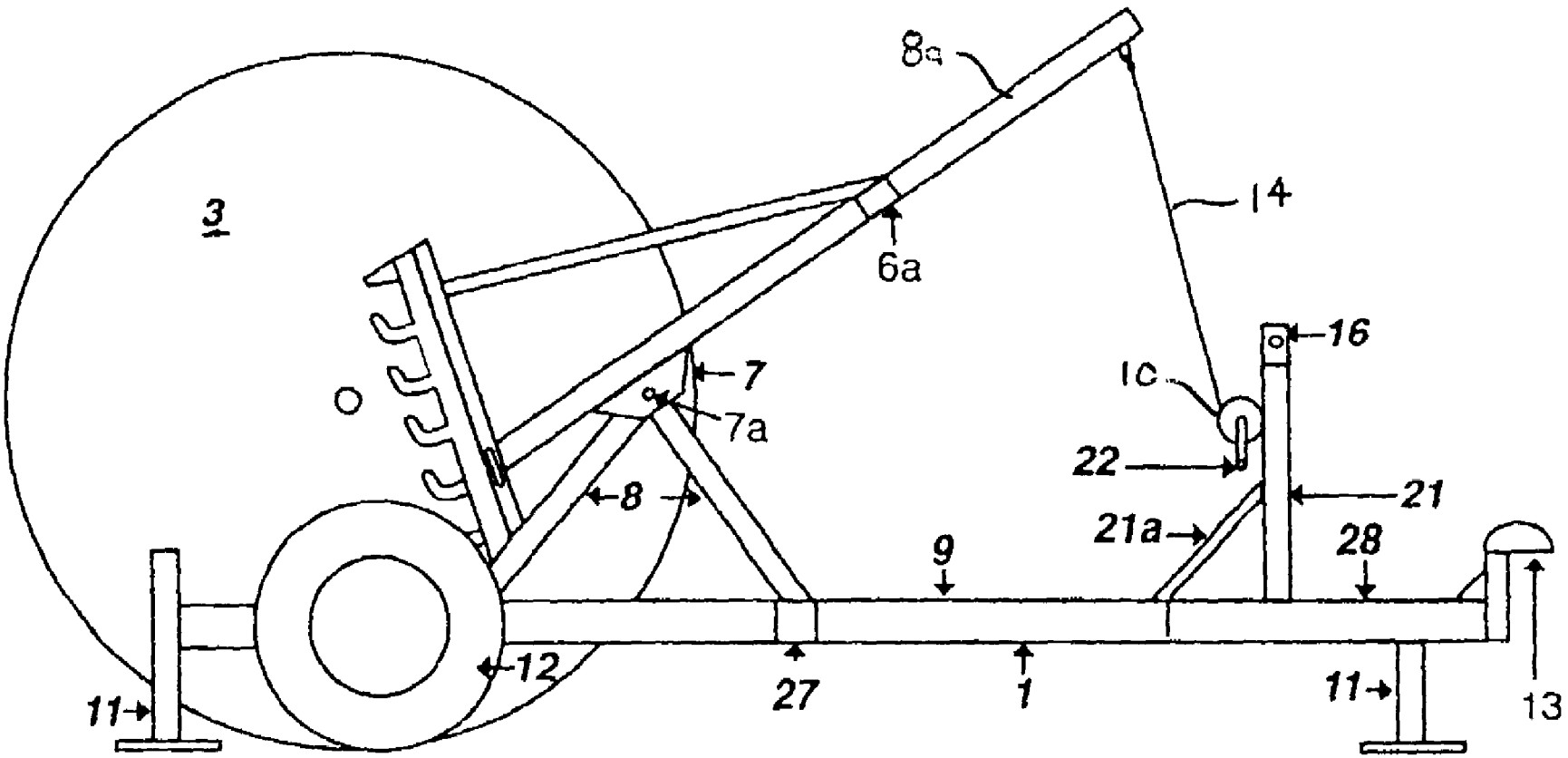
FIG. 9 is a view showing the pivoting spool rack in a loading position, and the cable is at it's full extension.
Figure 10:
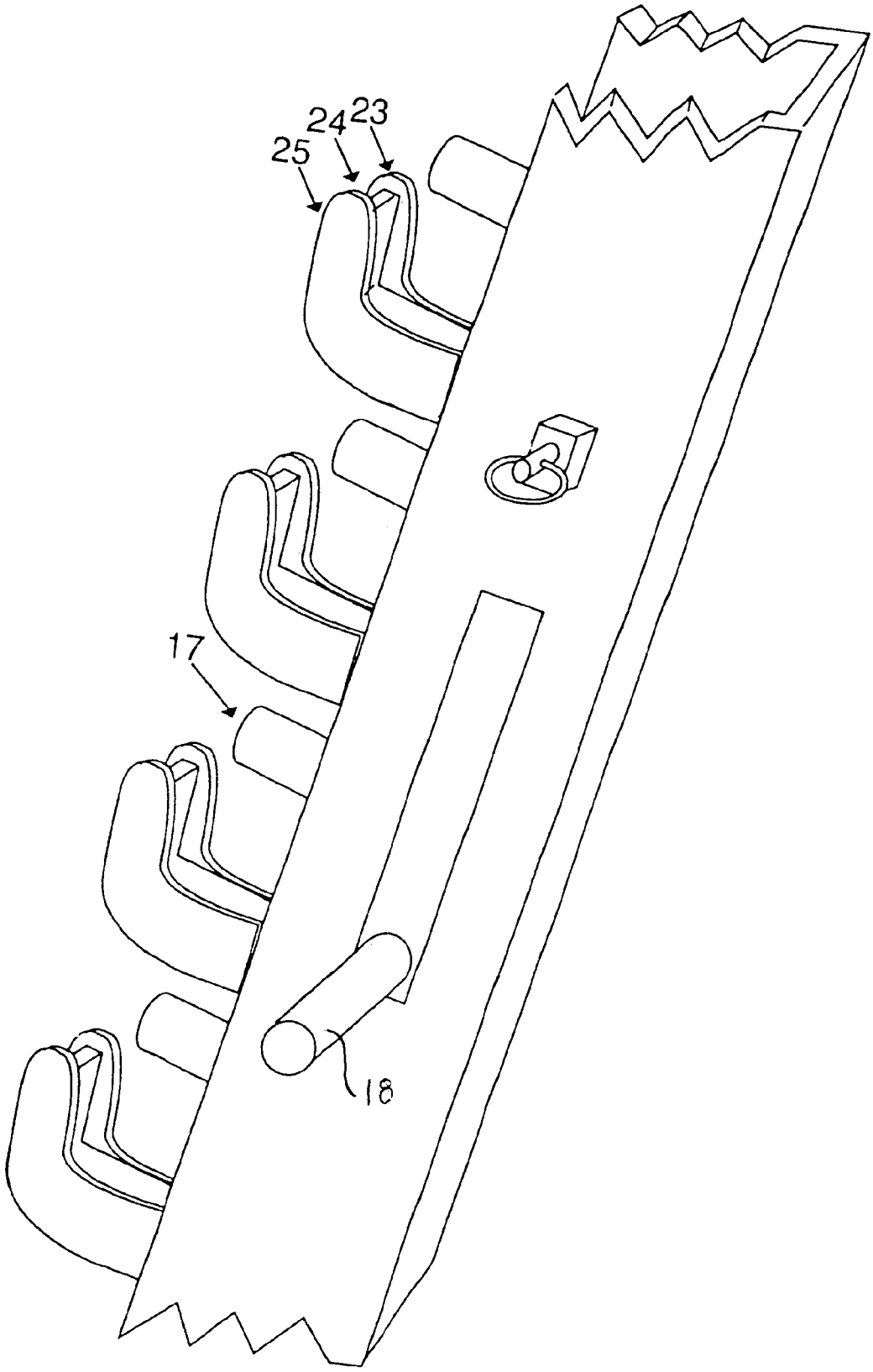
FIG. 10 is a view showing the locking bar with the handle.
Figure 11:
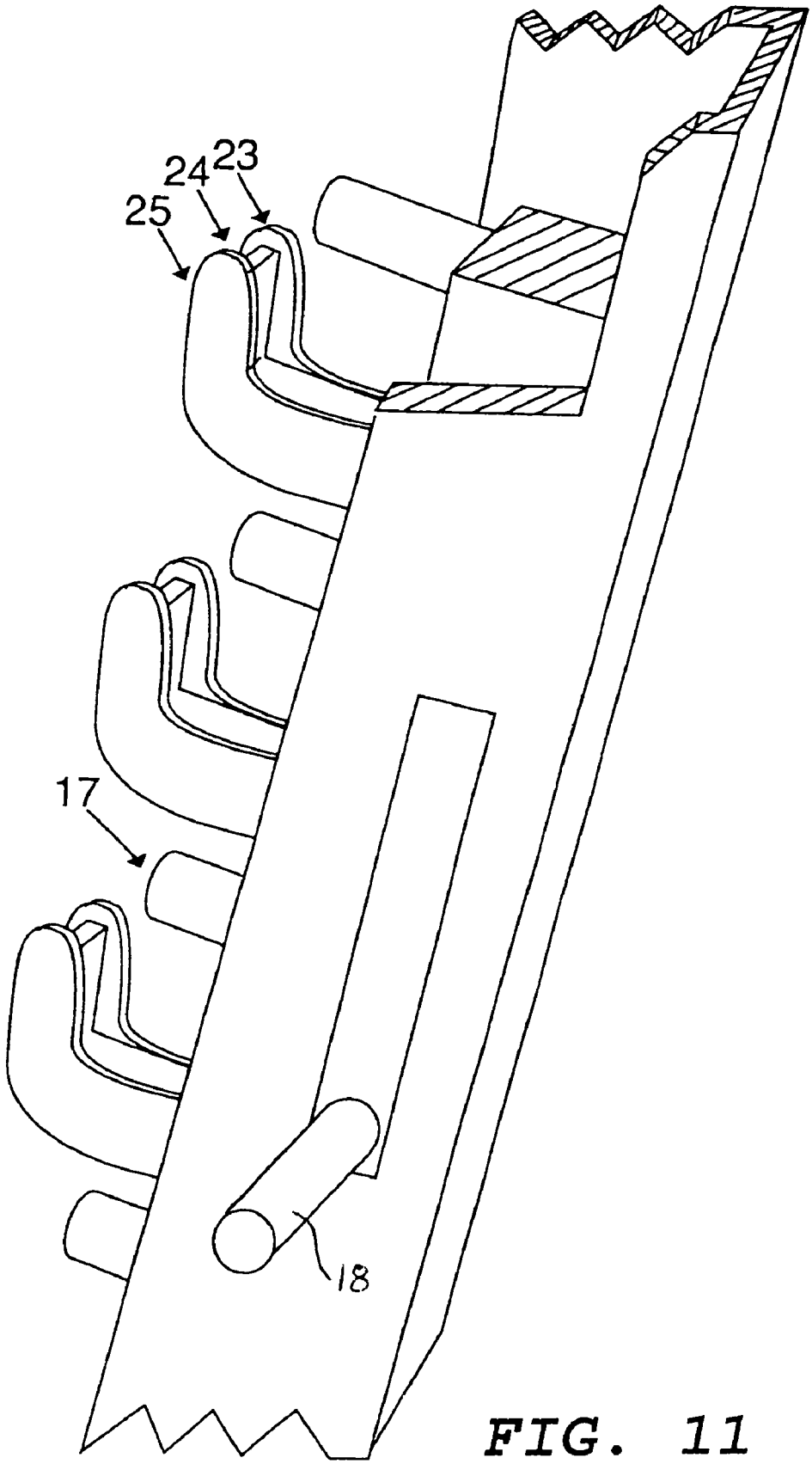
FIG. 11 is a perspective view showing the interior of the locking bar on the rack.
Figure 12:
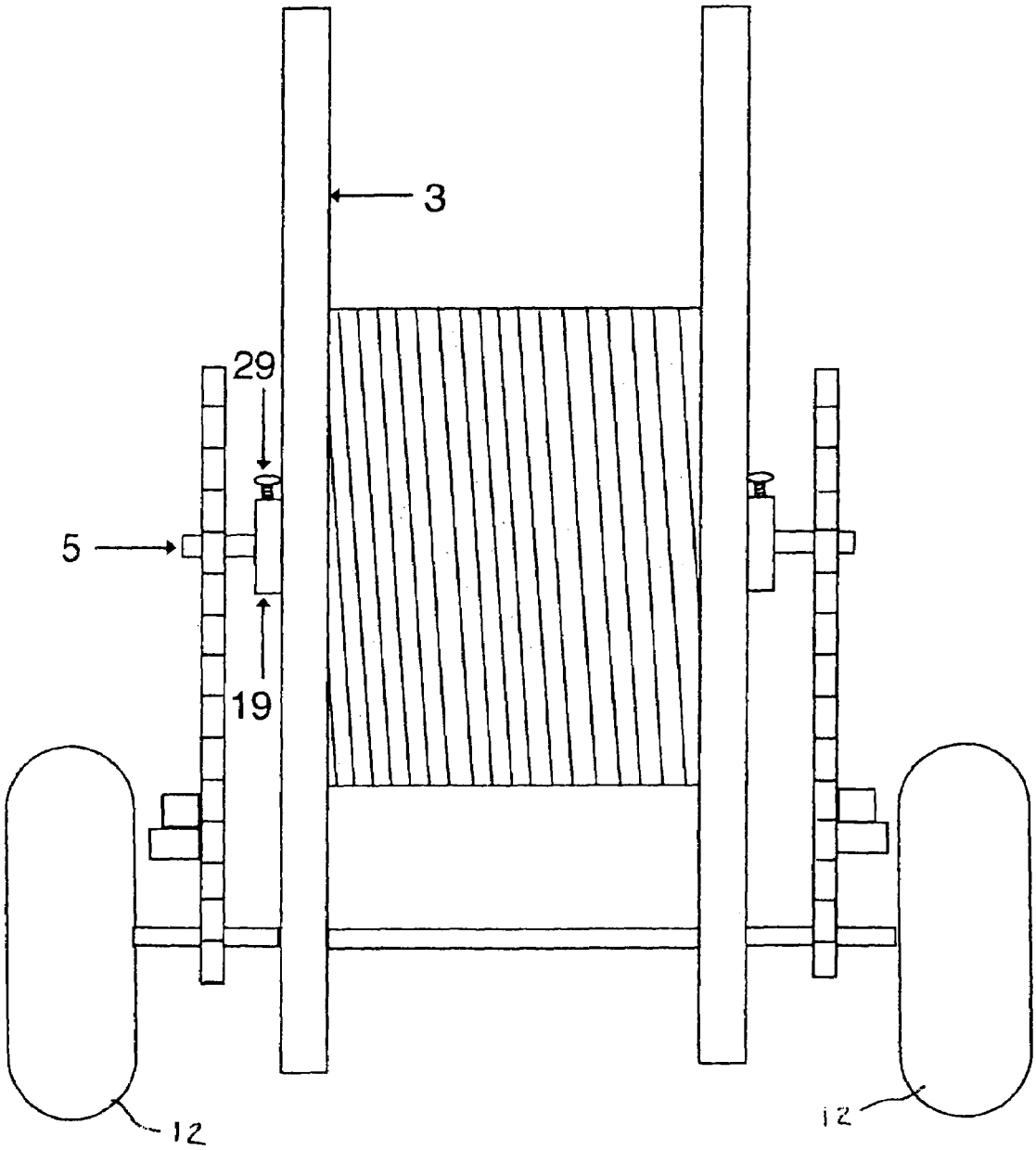
FIG. 12 is an end view showing collars attached to the spindle and holding the spool in the centered position.
Figure 13:
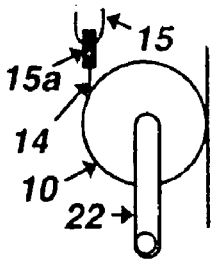
FIG. 13 is an enlarged side view showing details of the winch.
Figure 14:
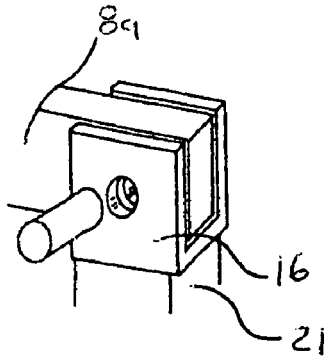
FIG. 14 is an enlarged perspective view of a locking pin arrangement.
Figure 15:
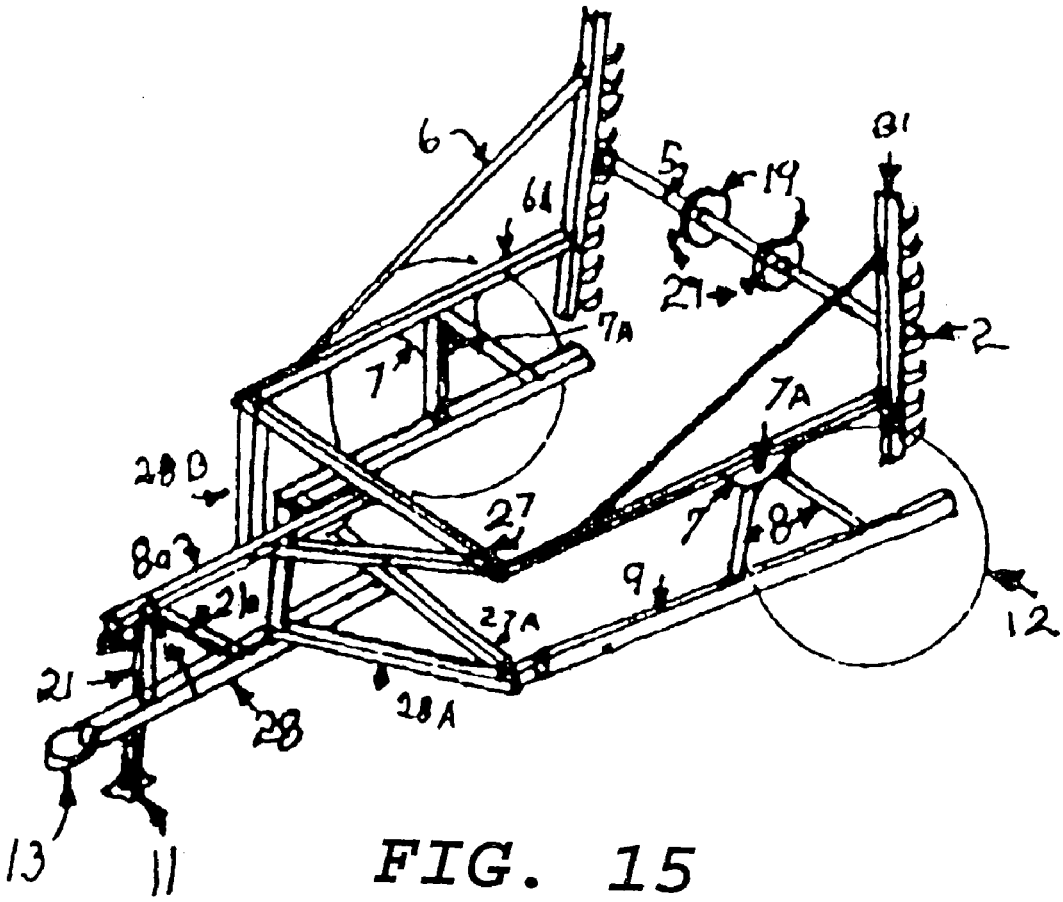
FIG. 15 is a perspective view of an alternate embodiment having a different locking pin arrangement.
Figure 16A:
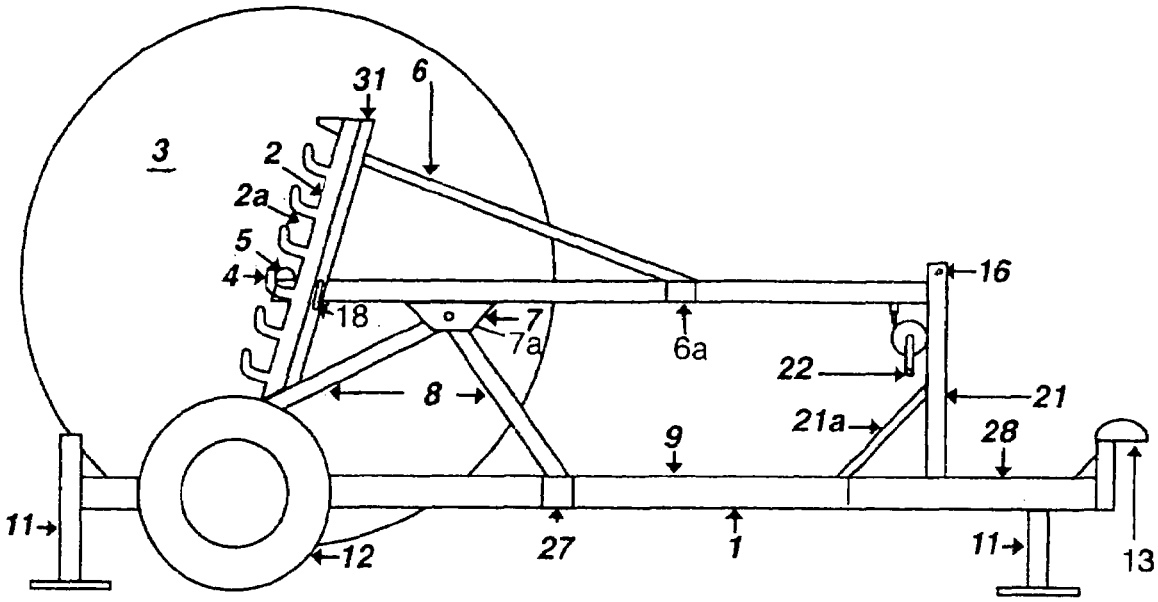
FIG. 16A is a side view of the alternate embodiment.
Figure 16B:
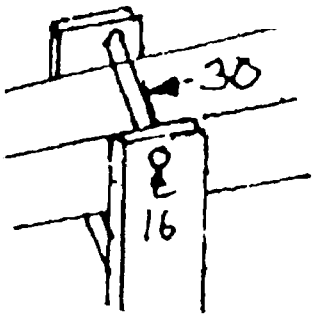
FIG. 16B is an enlarged perspective view of the alternate locking pin arrangement.
Figure 17:
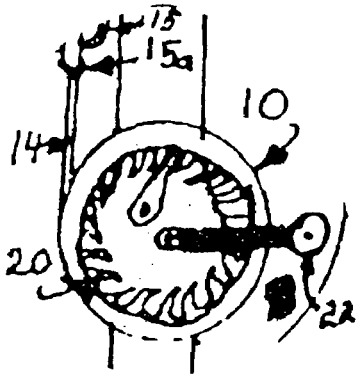
FIG. 17 is a side view showing details of the winch.

FIG. 9 shows the U-shaped lever arm assembly formed by a pair of horizontal upper rails (lifting arms) 6*a* connected at forward ends by a lateral lever arm support member (horizontal lateral cross member) 27, and to the lever arm 8*a*. A pair of angled support rails 6 extend between the horizontal lateral rails 6*a* and a spindle support rack 4. A pair of diagonal lever supports 28*b* extend between the lever arm 8*a* and the lever arm support member 27. The straight lever arm 8*a* raises and the pivoting spool rack 2 then descends down and forwardly toward the front of the trailer. A winch 10 is positioned on the inward side and half way up the vertical support member 21. Wound on the winch 10 is a wound structural steel cable 14 that is attached to a cable fastener U-bolt 15 located on the bottom side of the lever arms 8*a*. The wound structural steel cable 14 is attached to a cable fastener U-bolt 15 with a cable snap 15*a* on the opposite end of the winch 10. The winch 10 and the steel cable 14 with crank handle 22 and ratchet brake assembly 20 are commercially available. One could locate said cable fastener 15, cable 14, crank handle 22, and ratchet brake assembly 20 to numerous positions and still be functional. Other winching systems 10 like hydraulic assists or electric motors, solar, battery, or other assisting devices may be utilized. Obviously, modifications and numerous variations and positions, can be used to adapt the present invention without deviating from the scope of this invention.

When the winch 10 pays out cable 14, the forward end of the lever arm 8*a* raises upward while the pivoting spool rack 2 lowers in a circular motion that goes down and forward with respect to the structural frame of the trailer. The horizontal fulcrum 7 that is fabricated from steel plate is pivotally secured by a pin 7*a*. This forms a fulcrum that pivots around the pin 7*a* to form the mechanical advantages that allows one operator using the winch 10 to raise or lower the loaded pivoting spool rack 2. The structure that supports the fulcrum plates 7 and creates a pivot point for the lever arm 8*a* is attached to the rearward end of the fulcrum support rails 8 near the pivoting spool rack 2. The pivoting spool rack unit is secured to the fulcrum arms. This rack 2 forms the exterior fabricated locking system and pocket support rails 31. They include fabricated steel plates, laterally spaced layered steel that forms the supporting pockets 2*a*.

The spool spindles 5 run horizontally through the spools 3. The spindle 5 is meant to support the spool 3 as it rests in the pockets of the pivoting spool rack. There is a pair of collars 19 for each spool 3 and they are loaded on a spindle 5 before the spindle 5 is secured in the pockets 2*a*. To keep the spools 3 centered on the spool spindle 5, one collar 19 is slid on either side of the spindle 5. The collars 19 keep the loaded spool 3 centered on the spindle 5 during loading, unloading or transport of the spools 3. The collars 19 have a hole in the center that makes for a snug fit on the spindle 5. There are wing nuts 29 that go through the collars 19 and this tightens the collars 19 by pinching the collars down on the spindles 5. The wing nuts 29 secure the collars onto the spindles 5.

FIGS. 7-12 show a spindle support rack (rack member) 4 that has a system 17 for locking and securing the spindles 5 in the pockets 2*a*. The pivoting spool rack 2 is made out of fabricated steel plate welded together. In a cross section, FIGS. 7A and 7B show the inner pocket layer 23, the middle pocket layer 24, and the outer pocket layers 25. Included in the pivoting rack system, inside of this rack, there is a locking system.

The spindle securing and locking rack (securing rack) SSLR 17 is located on the interior wall of the rack 2 extending outwardly over the top of the spindle 5 which has been placed in the pockets 2*a*. FIGS. 10A and 10B show that the rack handle 18 is located on the exterior fabricated locking system and pocket support rail 31. The handle 18 is used to lift the SSLR 17 and the locking pin mechanism (locking device) 17*a* can be located anywhere along the outer fabricated locking system and support rail 31.

The locks that are located in the SSLR 17 system are in this embodiment a spring loaded pin system. The pocket supporting brackets 24*a* that are fabricated to support the pockets 2*a* where the spool spindles 5 are resting can be designed to supply greater support or redesigning the inner pocket layer 23, middle pocket layer 24, or outer pocket layer 25 that form the exterior fabricated locking system and pocket support rail 31 to accommodate various sizes in spool spindles or weights or changes in spindle designs.

To load a spool, the following operations are performed: First, the operator pulls the locking pin from above the yoke at the end of the pivoting support arm at the front of the trailer. Second, the operator releases the locking mechanism on the winch located just below the yoke. Third, the operator unwinds cable from the winch in a controlled fashion. This allows the parallel support arm to raise and the rack which is on the opposite end and on the opposite side of a fulcrum to lower. A spool having a center spindle is then positioned in the U-shaped pockets on the rack. Fourth, the locking device is engaged to secure the spool in place. Fifth, the operator winches in cable lowering the front of the pivoting support arm and raising the spool which is at the opposite end of the fulcrum into transport position. Sixth, the operator engages a lock on the winch. Last, the operator replaces the locking pin located above the yoke which supports the pivoting support arm.

For this preferred embodiment of the invention, the structural materials, configurations, arrangements, or dimensions are not limitations. Changing or modifying the structural materials, dimensions, or configurations will not be departing from the scope of this invention. It is then understood that the embodiments described above and below, are not limited to them, but that they will encompass any and all of the embodiments that will fall within the spirit and scope of the present invention and the claims that follow.

What is claimed is:

1. A loading system, comprising:

a main frame supported by a plurality of wheels, the main frame including a pair of spaced-apart support arms extending in a longitudinal direction of the loading system;

a lifting frame pivotally attached to said main frame, said lifting frame including a lever arm and a pair of spaced-apart lifting arms directly connected to the lever arm, the pair of spaced-apart lifting arms extending in the longitudinal direction of the loading system, the pair of spaced-apart lifting arms of the lifting frame in conjunction with the pair of spaced-apart support arms of the main frame defining a spool receiving volume in the rear of the loading system;

a support rack attached to said lifting arms, said support rack comprising a pair of spaced-apart rack members, said rack members being configured to support a spool, each rack member extending mainly vertically from one of the lifting arms; and a connecting device for connecting said lifting frame to the main frame to prevent pivoting movement of said lifting frame, wherein the rear of said loading system is open to afford the loading, transporting, and unloading of spools, and wherein each of said rack members includes a plurality of pockets at various heights along said rack members to accommodate different sized spools, the pockets forming a resting and securing place for ends of spindles upon which spools are positioned, wherein the plurality of pockets are U-shaped pockets, wherein each of said rack members includes a locking device and a securing rack for holding the spindles in said pockets, and wherein said securing rack is kept in position by the locking device which is spring loaded to hold it in one of a locking position, engaged position, unlocked position, or disengaged position.

2. The loading system according to claim 1, further comprising at least one jack stand attached to said main frame for stabilizing said loading system when not connected to a towing vehicle.

3. The loading system according to claim 1, wherein said main frame includes a tongue with a hitch mounted at the front of said tongue for towing said loading system.

4. The loading system of claim 3, wherein said main frame includes a horizontal lateral cross member interconnecting forward ends of said spaced-apart support arms and to which a rearward end of said tongue is attached.

5. The loading system according to claim 1, wherein said connecting device comprises a U-shaped yoke fastened to a vertical support member extending upwardly from said main frame, and a pin for interconnecting said U-shaped yoke to said lever arm.

6. The loading system according to claim 1, wherein said main frame includes a tongue operably connected to the pair of spaced-apart support arms.

7. The loading system according to claim 6, wherein each of said support arms includes a pair of fulcrum arms extending upwardly diagonally therefrom.

8. The loading system of claim 1, wherein a spool may be secured in position on a spindle using locking and centering collars on both sides of the spool.

9. The loading system of claim 1, wherein said lifting frame includes a horizontal lateral cross member interconnecting forward ends of said spaced-apart lifting arms and to which a rearward end of said lever arm is attached.

10. The loading system according to claim 1, wherein the loading system is adapted to carry bales, the bales being held in place by bale penetrating bars.

11. The loading system according to claim 10, wherein said bars are supported by corresponding pockets of said plurality of pockets along the rack members.

12. The loading system according to claim 1, wherein the loading system is adapted to carry bales, the bales being held in place by bale engaging and holding members, which are rotatably mounted on a spindle and are held in place by collars.

13. The loading system according to claim 12, wherein the engaging and holding members are rotatable over the spindle allowing the bale to unroll.

14. The loading system of claim 1, wherein each of the pair of spaced-apart support arms extend substantially parallel to each other.

15. The loading system of claim 1, wherein said pockets are of a plurality of sizes to accommodate various spool and spindle diameters.

16. A loading system, comprising:

a main frame supported by a plurality of wheels, the main frame including a pair of spaced-apart support arms extending in a longitudinal direction of the loading system, each of said support arms including a pair of fulcrum arms extending upwardly diagonally therefrom;

a lifting frame pivotally attached to said main frame, said lifting frame including a lever arm and a pair of spaced-apart lifting arms directly connected to the lever arm, the pair of spaced-apart lifting arms extending in the longitudinal direction of the loading system, the pair of spaced-apart lifting arms of the lifting frame in conjunction with the pair of spaced-apart support arms of the main frame defining a spool receiving volume in the rear of the loading system;

a pair of trapezoidal plates, each trapezoidal plate joining upper ends of a corresponding pair of said pair of fulcrum arms, wherein said pair of fulcrum arms form a triangle wherein two bottom corners of said triangle are fastened to the main frame and said trapezoidal plate is at an apex of said triangle, said apex being connected to said lifting frame;

a support rack attached to said lifting arms, said support rack comprising a pair of spaced-apart rack members, said rack members being configured to support a spool, each rack member extending mainly vertically from one of the lifting arms; and a connecting device for connecting said lifting frame to the main frame to prevent pivoting movement of said lifting frame, wherein the rear of said loading system is open to afford the loading, transporting, and unloading of spools.

17. The loading system of claim 16, wherein said trapezoidal plates have holes drilled, cast, cut or stamped in them to accommodate a pin and to function as a fulcrum.

18. The loading system of 16, wherein the plurality of pockets are U-shaped pockets.

19. The loading system of claim 18, wherein said pockets are of a plurality of sizes to accommodate various spool and spindle diameters.

20. The loading system of claim 18, wherein each of said rack members includes a locking device and a securing rack for holding the spindles in said pockets.

21. The loading system of claim 20, wherein said securing rack is kept in position by the locking device which is spring loaded to hold it in one of a locking position, engaged position, unlocked position, or disengaged position.

22. The loading system according to claim 16, wherein said main frame includes a tongue with a hitch mounted at the front of said tongue for towing said loading system.

23. The loading system according to claim 16, wherein said connecting device comprises a U-shaped yoke fastened to a vertical support member extending upwardly from said main frame, and a pin for interconnecting said U-shaped yoke to said lever arm.

24. The loading system of claim 16, wherein a spool may be secured in position on a spindle using locking and centering collars on both sides of the spool.

25. The loading system of claim 16, wherein said lifting frame includes a horizontal lateral cross member interconnecting forward ends of said spaced-apart lifting arms and to which a rearward end of said lever arm is attached.

26. The loading system according to claim 16, wherein the loading system is adapted to carry bales, the bales being held in place by bale penetrating bars.

27. The loading system according to claim 26, wherein said bars are supported by corresponding pockets of said plurality of pockets along the rack members.

28. The loading system according to claim 16, wherein the loading system is adapted to carry bales, the bales being held in place by bale engaging and holding members, which are rotatably mounted on a spindle and are held in place by collars.

29. The loading system according to claim 28, wherein the engaging and holding members are rotatable over the spindle allowing the bale to unroll.

30. The loading system of claim 16, wherein each of the pair of spaced-apart support arms extend substantially parallel to each other.

* * * * *